US006295963B1

(12) United States Patent
Kollock et al.

(10) Patent No.: US 6,295,963 B1
(45) Date of Patent: Oct. 2, 2001

(54) FOUR CYCLE ENGINE FOR A MARINE PROPULSION SYSTEM

(75) Inventors: Mark A. Kollock, Oshkosh; Erik J. Christiansen, West Bend, both of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/685,460

(22) Filed: Oct. 9, 2000

(51) Int. Cl.[7] ..... F02B 75/20
(52) U.S. Cl. ..... 123/193.5; 123/195 HC
(58) Field of Search ..... 123/195 HC, 193.5, 123/90.27; 440/88

(56) References Cited

U.S. PATENT DOCUMENTS

| | | | | |
|---|---|---|---|---|
| 4,346,676 | | 8/1982 | Tyner . | |
| 4,684,351 | | 8/1987 | Watanabe et al. . | |
| 4,787,869 | | 11/1988 | Shiozawa . | |
| 4,932,367 | * | 6/1990 | Newman et al. | 123/184.31 |
| 4,965,997 | | 10/1990 | Suzuki et al. . | |
| 5,036,805 | * | 8/1991 | Yamamoto et al. | 123/59.5 |
| 5,634,832 | * | 6/1997 | Nakase et al. | 440/88 |
| 5,899,197 | * | 5/1999 | Watanabe et al. | 123/572 |
| 5,964,197 | * | 10/1999 | Koishikawa et al. | 123/195 HC |
| 5,970,926 | | 10/1999 | Tsunoda et al. . | |
| 6,055,970 | | 5/2000 | Takahashi . | |

* cited by examiner

*Primary Examiner*—Marguerite McMahon
(74) *Attorney, Agent, or Firm*—William D. Lanyi

(57) ABSTRACT

A marine engine is made with a head portion that includes an exhaust manifold that is formed as an integral part of the head portion during a lost foam casting procedure. The head portion comprises a plurality of combustion chambers in which each combustion chamber has at least one exhaust throat that connects the combustion chamber in fluid communication with at least one exhaust port. All of the exhaust ports connect associated combustion chambers in fluid communication with an exhaust manifold that is formed integrally within the head portion during the initial lost foam casting process. An exhaust outlet opening from the exhaust manifold is positioned above at least one exhaust port of at least one combustion chamber to form a water trap or stand pipe that inhibits water ingestion under certain adverse conditions. Water passages and oil passages are formed integrally within the head portion during the lost foam casting process. The head portion of the present invention reduces the number of components needed to provide the functions of the cylinder head portion and, as a result, improves reliability and reduces cost.

19 Claims, 6 Drawing Sheets

FOUR CYCLE ENGINE FOR A MARINE PROPULSION SYSTEM

BACKGROUND OF THE INVENTION

1. Field of the Invention

The present invention is generally related to a four cycle engine of a marine propulsion system and, more particularly, to an engine in which an exhaust manifold is cast as an integral part of the head portion of the marine engine in a way that forms a water dam, or standpipe, that prevents water from being ingested into the cylinders of the engine through the exhaust system.

2. Description of the Prior Art

Many different types of marine engines are known to those skilled in the art. More specifically, marine engines are defined herein as comprising a block portion and a head portion which, respectively, support a crankshaft and cam shafts for rotation about vertical axes. These marine engines are used in conjunction with outboard motors for attachment to a transom of a marine vessel. Marine engines can be two cycle or four cycle, with the pistons and cylinders of the engine being arranged in a V-configuration, opposed piston movement, or an in-line configuration.

Marine engines are provided with an exhaust system in which the exhaust gases from all of the cylinders are typically collected within an exhaust manifold and then conducted to an exhaust outlet of the outboard motor, either under or above the surface of the body of water in which the related marine vessel is operated.

One problem that occurs in marine engines is referred to as water ingestion. This occurs, under certain circumstances, when water is disadvantageously drawn in a reverse direction through the exhaust system and into one or more cylinders of the engine through their exhaust ports. Water ingestion can cause serious problems and severe damage when it occurs. Water ingestion can occur during rapid deceleration modes of operation, particularly when the engine is mounted on the marine vessel at a position low enough to place one or more of the cylinders near or below the level of the body of water in which the marine vessel is operated.

Another concern with regard to marine engines is the cost of manufacturing and assembling the engine and its related components. The exhaust manifold of a marine engine is typically cast as a separate part and then attached to the engine. When a separate exhaust manifold component is attached to an engine, the mating surfaces must be sealed and the components must be rigidly bolted together. The use of a separate exhaust manifold increases the cost of manufacturing a marine engine. In an outboard application, it is typical for the exhaust manifold to be cast as an integral part of the cylinder block of the engine, with a separate cover component used to seal the water jacket.

Another concern related to marine engines is the dissipation of heat generated by the combustion events within the combustion chambers of the engine. Hot exhaust gases must be expelled from the engine in an efficient and expeditious manner and the heat associated with the exhaust gases typically raise the temperature of associated components to relatively high temperatures. Known marine engines place the exhaust manifold on or within the block portion of the engine. Since the combustion chambers of the engine are located within the head portion, the existence of the exhaust manifold on or within the block portion of the engine creates two regions of extreme heat generating processes. The combustion events occur within the combustion chambers and therefore generate significant heat within the head portion of the engine. The passage of the hot exhaust gases through a manifold on or within an engine block creates excessive heat in the manifold itself and associated components within the block portion of the engine. As a result of these two sources of heat within the engine, the engine's cooling system must accommodate the removal of heat from these two heat loads which are not necessarily proximate each other.

U.S. Pat. No. 4,965,997, which issued to Suzuki et al on Oct. 30, 1990, describes an exhaust system for an outboard motor. The exhaust gas systems are intended to prevent the ingestion of water into the cylinders of an alternate firing multiple chamber internal combustion engine. The exhaust passages are provided with a restricted communication with each other at a point that is above the water under all running conditions so as to prevent water ingestion. In one embodiment, the exhaust passages communicate with an above the water exhaust gas discharge independently of each other and the restricted communication is provided between the passages by a restricted opening in an exhaust pipe. In another embodiment, the exhaust pipe forms an expansion chamber and the individual exhaust passages communicate with this expansion chamber at points close to each other through restricted openings for providing the communication.

U.S. Pat. No. 4,787,869, which issued to Shiozawa on Nov. 29, 1988, describes a water lock device for a marine propulsion system. Several embodiments of marine propulsion exhaust systems include water lock devices for precluding the entry of water into the engine through its exhaust ports. In each embodiment, the water lock device comprises a control valve that has flow openings for permitting the flow of exhaust gases through the control valve even when the control valve is in its closed position. The flow openings are, however, positioned so as to prevent the flow of water into the engine under these conditions. The openings also create different effective areas so that exhaust pressure tends to open the valve and water pressure tends to close the valve.

U.S. Pat. No. 5,970,926, which issued to Tsunoda et al on Oct. 26, 1999, describes an engine cooling system for an outboard motor. It includes first exhaust passages formed in a cylinder head, a second exhaust passage formed in a cylinder block and communicating with the first exhaust passages, and a cooling water passage having water jacket portions formed around the combustion chambers. The cooling water passage includes a first water jacket and a second water jacket. The cylinder head and the cylinder block are fixedly connected together by bolts. The second exhaust passage opens at a joining surface of the cylinder block along cylinders, which opening is surrounded by the bolts. The cooling water passage has water jacket portions formed between the bolts in the joining surface of the cylinder block such that they surround the opening of the block exhaust passage.

U.S. Pat. No. 6,055,970, which issued to Takahashi on May 2, 2000, describes a control system for an outboard motor. The control system includes a feedback control which obtains feedback data from a combustion condition sensor. The motor includes an engine positioned in a cowling having a vertically extending output shaft in driving relation with a water propulsion device of the motor. The engine has at least one combustion chamber and an air/fuel charging system for delivering air and fuel into the combustion chamber for combustion therein. The motor includes an exhaust system for routing exhaust from the engine to a point external to the motor. The exhaust system includes exhaust passage leading from the chamber to a main exhaust passage which extends vertically downward to an exhaust guide positioned below the engine. A passage leads from the exhaust guide into an expansion chamber and thereon to an exhaust discharge. The feedback control is arranged to adjust the ratio of air and fuel supplied to the combustion chamber and includes a combustion condition sensor mounted to exhaust gas flowing through that portion of the exhaust system positioned above the exhaust guide.

U.S. Pat. No. 4,684,351, which issued to Watanabe et al on Aug. 4, 1987, describes an outboard engine structure. The structure includes an extension case having a hollow portion formed therein and extending downwardly, the extension case being coupled with a lower surface of a crankcase of the vertical type engine, and including a driving shaft contained in the hollow portion of the extension case for transmitting power from the crankshaft of the engine to a propeller shaft. A cylinder block is connected at the rear of the engine with a cylinder head and slidably receives a piston on its cylinder bore, an exhaust passage block is interposed between the cylinder head and an extension section projecting rearwardly at the top of the extension case, and an exhaust port in the cylinder head communicating through an exhaust passage formed in the block with the hollow portion of the extension case. A water jacket is provided to surround the combustion chamber in the cylinder and extends axially of the cylinder bore to an intermediate portion thereof, and the inlet and outlet passages for the water jacket are formed in the cylinder head.

U.S. Pat. No. 4,346,676, which issued to Tyner on Aug. 31, 1982, discloses a two-cycle v-engine with an integrally cast exhaust manifold. The exhaust manifold for a water cooled, two-cycle, V-6 crankcase compression, outboard motor engine is cast integrally with the engine cylinder block.

The patents described above are hereby expressly incorporated by reference in the description of the present invention. These patents also illustrate the basic structures of various types of outboard motors. Therefore, the basic components of an outboard motor that are not directly related to the present invention will not be further described herein.

In view of the prior art, it would be significantly beneficial if a marine engine could be provided in which the number of components are reduced in order to decrease the cost of manufacture and assembly. It would further be a significant benefit if a marine engine could be provided in which the exhaust system was constructed in a way that inhibited the reverse flow of water through the exhaust system to the cylinders of the engine from the body of water in which a marine vessel is operated.

SUMMARY OF THE INVENTION

A preferred embodiment of an engine for a marine propulsion system made in accordance with the present invention comprises a head portion of the engine which has a plurality of combustion chambers formed therein. The plurality of combustion chambers are aligned vertically with respect to one another and the head portion of the engine is shaped to receive at least one cam shaft for rotation about a vertical axis. The engine further comprises an exhaust manifold formed integrally within the head portion of the engine and a plurality of exhaust ports formed within the head portion of the engine. Each of the exhaust ports is connected in fluid communication between an associated one of the plurality of combustion chambers and the exhaust manifolds.

A block portion of the engine can be attached to the head portion of the engine, and an exhaust outlet opening of the exhaust manifold is provided. The exhaust outlet opening has a center which is located above at least one of the pluralities of exhaust ports and below at least one of the plurality of exhaust ports.

In one particularly preferred embodiment of the present invention, the center of the exhaust outlet opening is located above at least two of the plurality of exhaust ports and below at least four of the plurality of exhaust ports. It should be understood that although a preferred embodiment of the present invention comprises two exhaust ports for each combustion chamber, it is not necessary to have more than one exhaust port connected in fluid communication with each combustion chamber in all embodiments of the present invention.

The engine further comprises an exhaust conduit formed within the block portion of the engine, wherein the exhaust conduit has an exhaust inlet opening. The exhaust outlet opening of the exhaust manifold is aligned with the exhaust inlet opening of the exhaust conduit within the block portion of the engine to form an exhaust passage which has a portion having a cross sectional area that is completely above at least one of said exhaust ports.

In a particularly preferred embodiment of the present invention, the engine has six combustion chambers and each of the six combustion chambers is vertically aligned with respect to each other of the six combustion chambers. The head portion of the engine, in a particularly preferred embodiment of the present invention, is made of a single aluminum casting with the exhaust manifold being formed integrally within the single aluminum casting of the head portion of the engine. Without the beneficial application of the lost foam casting process, it would be significantly difficult to provide an exhaust manifold with a water jacket. An oil passage can be cast within the head portion of the engine and disposed in fluid communication with cam shaft support structures that are also formed integrally within the head portion of the engine.

BRIEF DESCRIPTION OF THE DRAWINGS

The present invention will be more fully and completely understood from a reading of the description of the preferred embodiment, in conjunction with the drawings, in which.

DESCRIPTION OF THE PREFERRED EMBODIMENT

Figure 1:
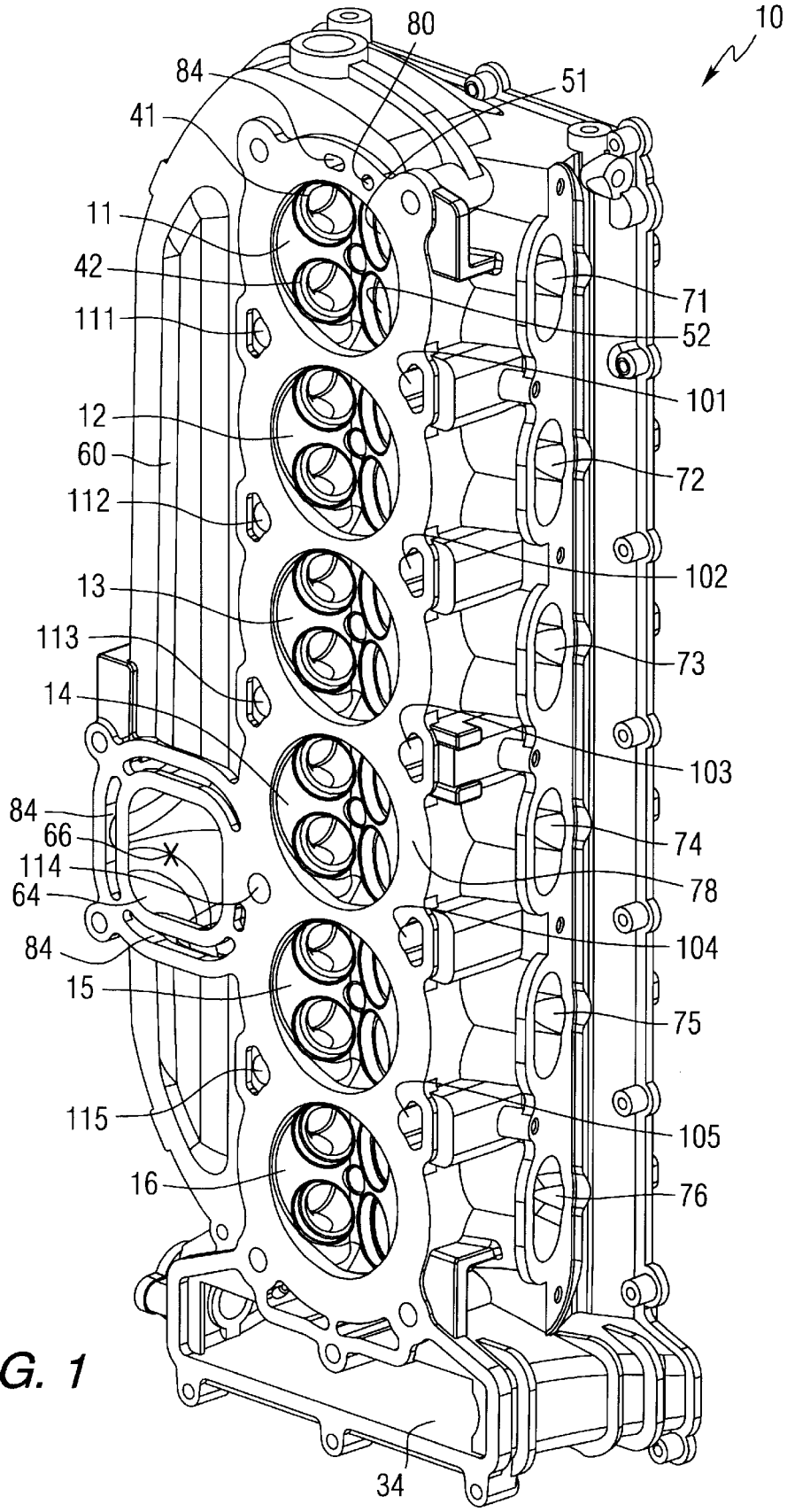
FIGS. 1 and 2 show isometric views of the head portion of an engine made in accordance with the present invention, from two different angles.

Throughout the description of the preferred embodiment of the present invention, like components will be identified by like reference numerals.

Figure 2:
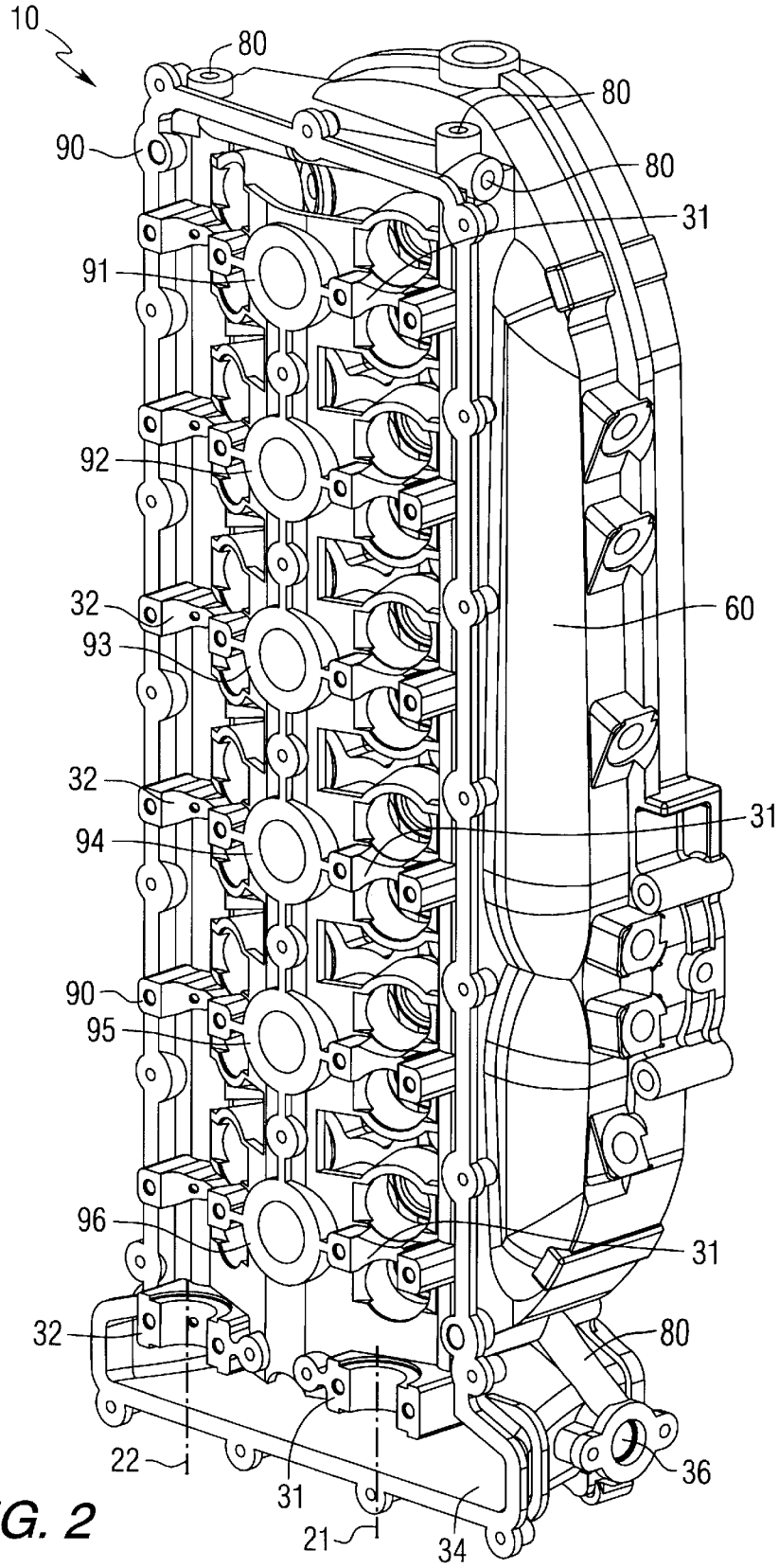

FIGS. 1 and 2 are two isometric views of the head portion of an engine made in accordance with the present invention. FIG. 1 is an isometric view in a direction viewed from the side of the head portion 10 at which a block portion (not shown in FIG. 1) of an engine would be attached to the head portion 10. FIG. 2 is a view from the side of the head portion 10 at which a cam cover (not shown in FIG. 1) would be attached to the head portion.

In FIGS. 1 and 2, the head portion 10 comprises six combustion chambers, 11–16, aligned vertically with each of the combustion chambers being disposed in vertical alignment with each of the other combustion chambers. The head portion 10 of the engine is shaped to receive two cam shafts for rotation about vertical axes 21 and 22. An exhaust cam shaft is supported by bearing pedestals 31 and an inlet cam shaft is supported by bearing pedestals 32. The head portion 10 is provided with a cam drive cavity 34 in which two sprockets can be contained, one attached to the inlet cam shaft and the other attached to the exhaust cam shaft. An opening 36 is provided to receive a cam drive tensioner device which is, essentially, a hydraulic cylinder that provides a force against a timing chain which is associated with the sprockets contained within the cam drive cavity 34.

Each of the combustion chambers, 11–16, is provided with two exhaust throats and two inlet throats. With reference to combustion chamber 11, the two exhaust throats are identified by reference numerals 41 and 42 and the two inlet throats are identified by reference numerals 51 and 52. For purposes of this description, all of the combustion chambers, 11–16, are identical. An exhaust manifold 60 is formed integrally within the head portion 10 of the engine. A plurality of exhaust ports, not shown in FIGS. 1 and 2, are formed within the head portion 10 of the engine and each of the exhaust ports is connected in fluid communication between an associated one of the exhaust throats, such as 41 and 42, and the exhaust manifold 60. The location of the plurality of exhaust ports will be described in greater detail below in conjunction with the section views provided of the head portion 10 in FIGS. 3 and 4. An exhaust outlet opening 64 of the exhaust manifold 60 is provided as a means for conducting exhaust gases out of the exhaust manifold 60. The exhaust outlet opening 64 has a center, identified by a X in FIG. 1 and by reference numeral 66, which is located above at least one of the plurality of exhaust ports within the head portion 10 and below at least one of the exhaust ports. As can be seen in FIG. 1, the center 66 of the exhaust outlet opening 64 is actually located at a point that is completely above combustion chambers 15 and 16 and, completely above the exhaust ports associated with the exhaust throats of combustion chambers 15 and 16. The head portion 10 shown in FIGS. 1 and 2 comprises six combustion chambers, 11–16, with two of the combustion chambers located below the center 66 of the exhaust outlet opening 64 and four of the combustion chambers, 11–14, located above the center 66.

The head portion 10 shown in FIG. 1 illustrates six air inlet ports, 71–76, which are connected in fluid communication with associated inlet throats, such as those identified by reference numerals 51 and 52, of associated combustion chambers. For example, air inlet port 73 is associated with the two inlet throats of combustion chamber 13. Reference numeral 78 is used to identify a flame face, or mating surface of the head portion 10 which is placed in contact with a corresponding mating surface of a block portion of the engine, as will be described in greater detail below.

The head portion 10 shown in FIGS. 1 and 2 is cast as a single component. In a preferred embodiment, the head portion 10 is cast in aluminum and a plurality of oil passages 80 are cast integrally within the head portion 10. These oil passages 80 provide a network of conduits through which oil can flow for the purpose of lubricating the various surfaces within the head portion 10 at which two components move in sliding association with each other. For example, these oil passages 80 provide oil flow for cams, associated cam surfaces, and bearing surfaces.

Various water jacket passages are also cast during the initial casting process in which the single piece head portion 10 is formed. Reference numeral 84 is used to identify several of these water passages.

In FIG. 2, reference numeral 90 identifies a cam cover surface against which a cam cover is attached to cover the cams and cam shafts supported for vertical rotation within the cavity defined by the head portion 10 and cam cover, which is not shown in FIG. 2. A plurality of spark plug bosses, 91–96, define holes that are intended to receive spark plugs which provide spark ignition for the air/fuel mixture within the combustion chambers, 11–16. In FIG. 1, a plurality of long bolt holes, 101–105, and 111–115, are provided to allow the head portion 10 to be bolted to a block portion of the engine. It should be understood that other long bolt holes, other than those identified by reference numerals and lead lines, are included in the head portion 10. Furthermore, it should also be understood that other water jacket passages, which are not specifically identified by reference numerals and lead lines, are also provided.

Figure 3:
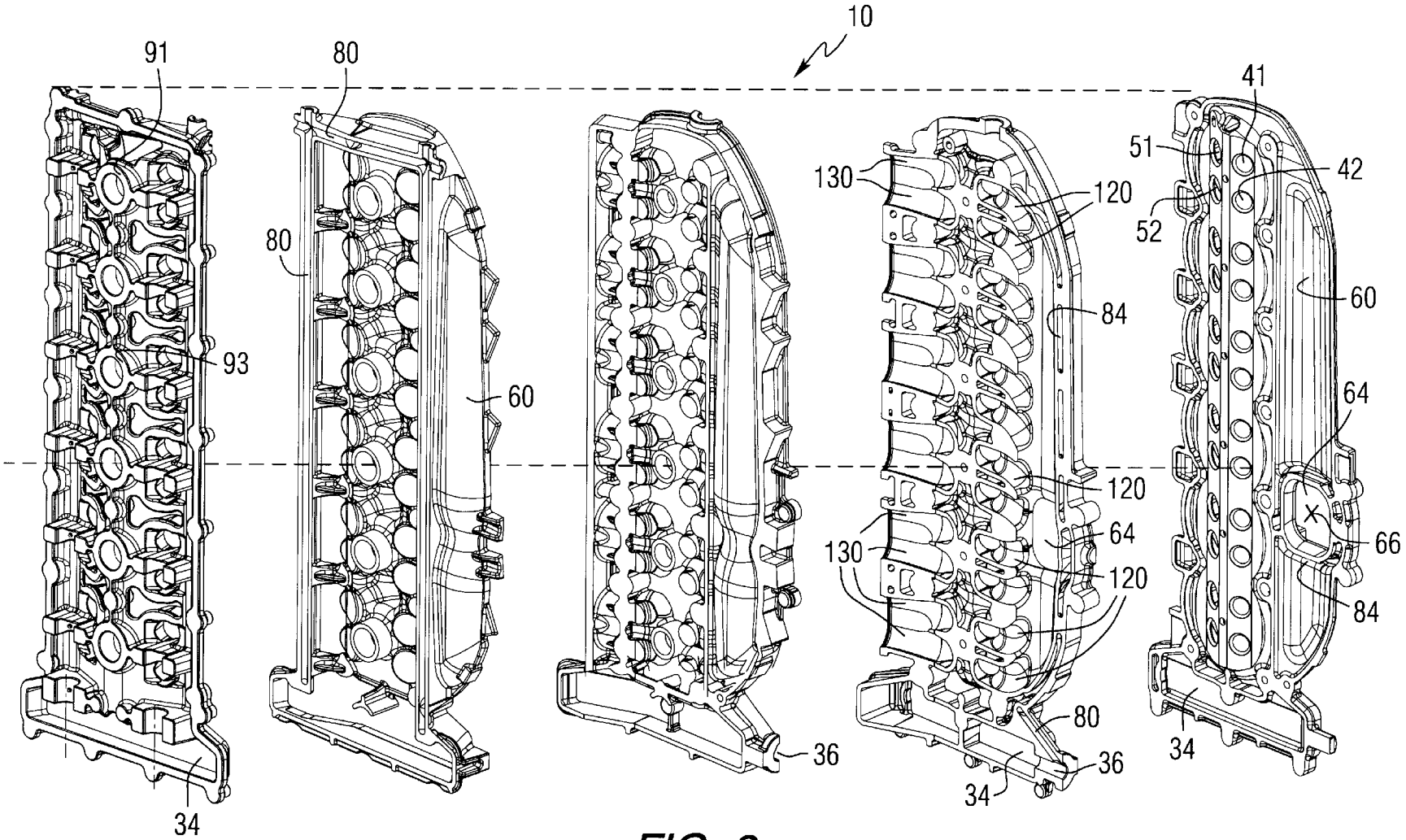
FIG. 3 is an exploded view of the head portion of an engine of FIG. 1 viewed from a first angle.

FIG. 3 is an exploded view showing five selected sections of the one-piece head portion 10 shown in FIG. 2. These sections of the head portion 10 illustrate the shapes of various internal portions of the head portions 10. In a rightmost section in FIG. 3, the exhaust throats, 41 and 42, and the inlet throats, 51 and 52, are shown for the combustion chamber 11. In addition, the other inlet throats and exhaust throats for combustion chambers 12–16 are also illustrated, but not identified by reference numerals in FIG. 3. Dashed lines are provided in FIG. 3 to show the relative positions of the five sections which form the integrally cast aluminum head portion 10. At the bottom of each section, a portion of the cam drive cavity 34 is shown. Two of the sections also show the cam drive tensioner bore 36. In FIG. 3, the position of the integral exhaust manifold 60 is illustrated with respect to the combustion chambers, 11–16, and the plurality of exhaust ports 120 are shown disposed in fluid communication between the exhaust throats and the exhaust manifold 60. Each combustion chamber, 11–16, is provided with two exhaust ports 120 which connect its two exhaust throats, 41 and 42, in fluid communication with the exhaust manifold 60. As a result, twelve exhaust ports 120 provide fluid communication between the six combustion chambers, 11–16, and the exhaust manifold 60. It should be understood that, in the views shown in FIGS. 2 and 3, the lead line associated with reference numeral 60 sometimes identifies the water jacket surrounding the exhaust manifold rather than the exhaust manifold itself. This occurs because the water jacket surrounds the exhaust manifold and, in certain views, blocks the view of the actual exhaust manifold itself. It can be seen, in the fourth section from the left in FIG. 3, that the bottom two combustion chambers have exhaust ports 120 which conduct exhaust gases at a slightly upward angle into the exhaust manifold 60 whereas the top four combustion chambers have exhaust ports 120 which conduct exhaust gases at a slightly downward angle into the exhaust manifold 60. It can also be seen that the exhaust outlet 64, and particularly its center 66, is above the exhaust ports 120 of the two lowest combustion chambers, 15 and 16. Although the combustion chambers can not be seen directly in FIG. 3 because they are located to the right side of the rightmost section, it can be seen from the association of the five sections in FIG. 3 that all four of the exhaust ports 120 associated with the bottom most combustion chambers, 15 and 16, are located below the center 66 of the exhaust outlet opening 64. Also shown in FIG. 3 are the various oil passages 80 and water passages 84.

Even though the head portion 10 is shown in five sections in FIG. 3, it should be understood that it is manufactured as a single aluminum casting made by the lost foam casting process. In manufacturing the foam pattern necessary to cast the head portion 10 in a single casting step, the five sections shown in FIG. 3 are manufactured as foam sections and then attached together to form a one-piece foam version of the head portion 10. This foam version of the head portion 10 is then used, in the lost foam casting process, to form an integrally cast aluminum head portion 10 with an integrally formed exhaust manifold 60. All of the passages shown in FIGS. 1, 2, and 3 and cast in place, including the water passages 84 and oil passages 80.

With continued reference to FIG. 3, inlet ports 130 are also formed within the head portion 10 during the casting process and each of the inlet ports is connected in fluid communication with an associated inlet throat, such as those identified by reference numerals 51 and 52. The inlet ports 130 are bifurcated to divide the incoming air flow from an air intake manifold into two distinct air flows for each combustion chamber, 11–16, so that the air is divided and conducted through the inlet throats, such as those identified by reference numerals 51 and 52 in FIG. 3.

Figure 4:
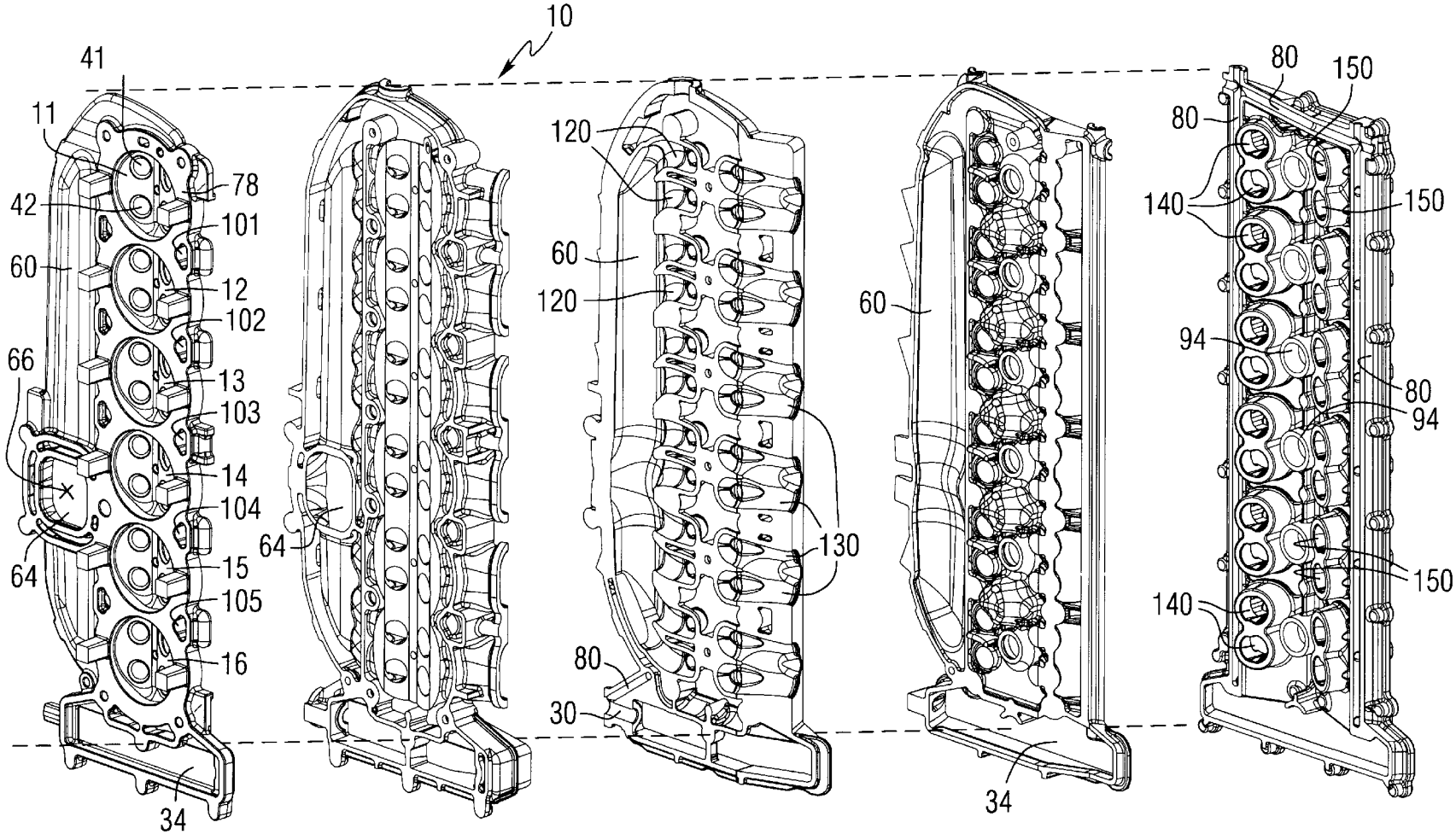
FIG. 4 is an exploded view of the head portion of an engine of FIG. 2 viewed from an angle different than FIG. 3.

FIG. 4 is an exploded view showing five sections of the head portion 10 of FIG. 1. Selected elements in FIG. 4 are identified with the reference numerals used to describe them in conjunction with FIG. 1. The exhaust outlet 64, and its center 66 are shown in the leftmost section in FIG. 4 in relation to the six combustion chambers, 11–16, which are each provided with two inlet throats and two exhaust throats. The inlet ports 130 are shown most clearly in the center segment of FIG. 4. Similarly, exhaust ports 120 are also most clearly seen in the center segment of FIG. 4. These exhaust ports 120 connect the exhaust manifold 60 in fluid communication with the exhaust throats of the individual combustion chambers, 11–16, and they direct the flow of exhaust gases from the combustion chambers into the exhaust manifold 60. The exhaust outlet 64 then conducts the exhaust gases out of the exhaust manifold 60.

With reference to the rightmost section in FIG. 4, it can be seen that tappet holes 140 are provided for the tappets of valves (not shown) which move reciprocally to open and close the exhaust throats. Each exhaust throat is provided with one tappet hole 140 and, since two exhaust throats are provided for each combustion chamber, 11–16, twelve exhaust tappet holes 140 are provided. Similarly, inlet tappet holes 150 are provided to contain the tappets associated with the valves that move reciprocally to open and close the inlet throats associated with each of the combustion chambers, 11–16. Since each combustion chamber is provided with two inlet throats, twelve inlet tappet holes 150 are contained within the head portion 10. The spark plug bosses 94 are also visible in the rightmost section of FIG. 4.

In FIG. 4, it can be seen that the exhaust manifold 60 is cast as an integral portion of the head portion 10 of the engine. It can also be seen that the exhaust ports 120 are provided as integral passages within the single piece head portion 10 to allow fluid communication between the exhaust throats of each of the combustion chambers, 11–16, and the exhaust manifold 60.

Figure 5:
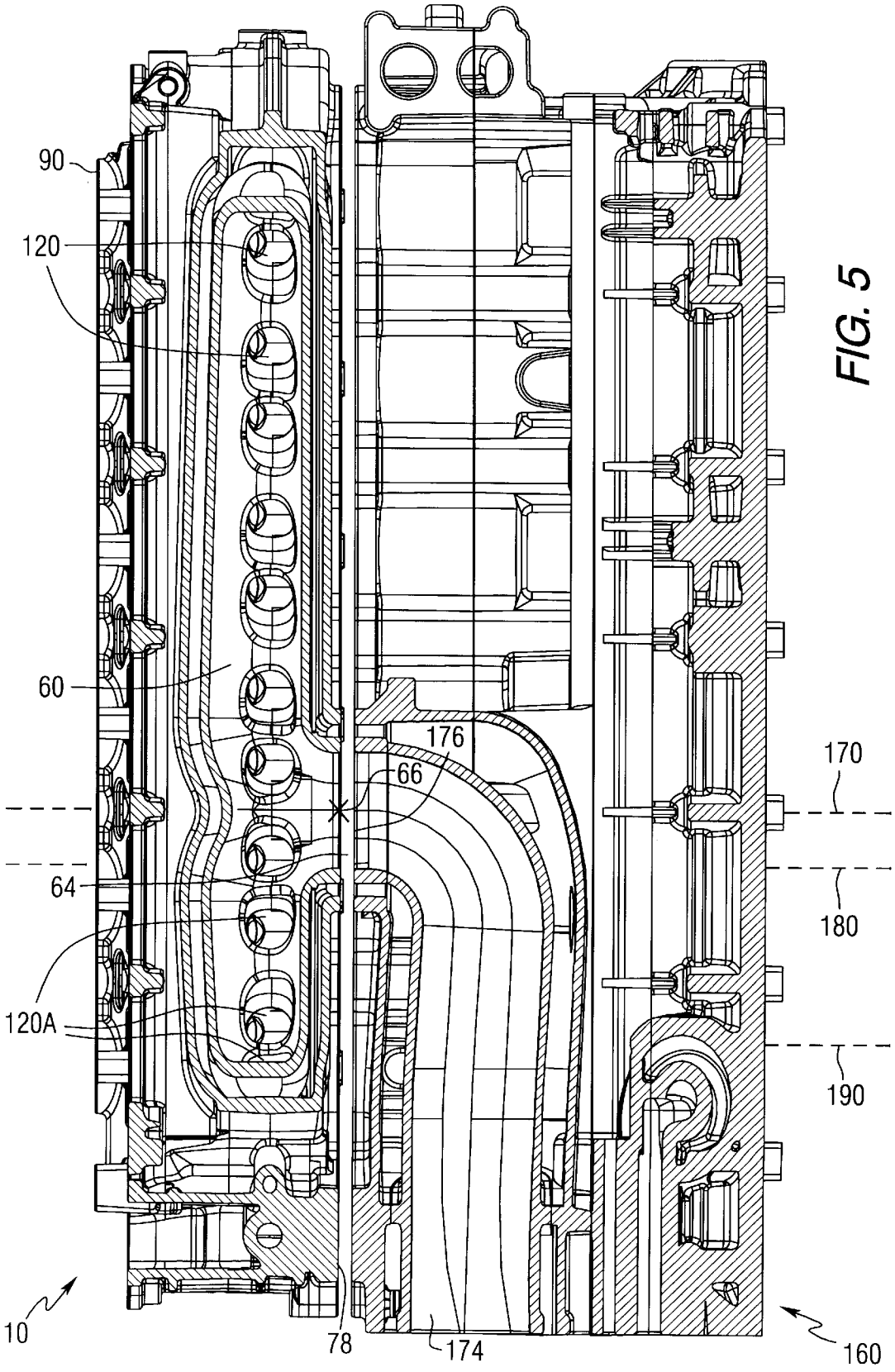
FIG. 5 shows a section view of a head portion associated with the section view of a block portion of an engine, wherein the section is taken through the exhaust manifold of the head portion and the exhaust conduit of the block portion.

FIG. 5 shows a section view of the head portion 10 alongside a section view of a block portion 160 of a marine engine. The section views are taken through the center 66 of the exhaust outlet opening 64 and also through the center of the exhaust manifold 60. In FIG. 5, the exhaust ports 120 are shown intersecting with the inner surface of the exhaust manifold 60 to provide the fluid communication between the exhaust manifold 60 and the exhaust throats of the six combustion chambers, 11–16. The center 66 of the exhaust outlet opening 64 is located on dashed line 170 for purposes of providing a reference for the following description of the present invention. The block portion 160 of the engine is provided with an exhaust conduit 174 that has an exhaust inlet opening 176. The exhaust outlet opening 64 of the exhaust manifold 60 in the head portion 10 is aligned with the exhaust inlet opening 176 of the exhaust conduit 174 to form an exhaust passage which has a portion having a cross sectional area that is completely above at least one of the exhaust ports 120. The cross sectional area of the exhaust conduit 174, taken at the exhaust inlet opening 176 is completely above the exhaust ports 120 which are identified by reference numeral 120A.

With continued reference to FIG. 5, it can be seen that the lowest portion of the cross section of the exhaust conduit 174, taken at the exhaust inlet opening 176 is defined by dashed line 180. Dashed line 180 is above the three of the exhaust ports 120 which are identified by reference numeral 120A. Furthermore, the exhaust inlet opening 176 of exhaust conduit 174 and the exhaust outlet opening 64 are both completely below seven of the exhaust ports 120. The structure of the exhaust manifold 60, in combination with the structure of the exhaust conduit 174 formed within the block portion 160 of the engine, combine to define a "stand pipe" or "water trap" or "water dam" shape that prevents water from flowing upward through the exhaust conduit 174 toward the exhaust inlet opening 176 and into the exhaust manifold 60. Dashed line 190 defines the approximate level of the surface of the body of water in which the marine engine is operated when the associated marine vessel is at rest and filly loaded. In order for water to be drawn upward through the exhaust conduit 174 and into one or more of the exhaust ports 120, the water must be drawn upward above the level identified by dashed line 180 and provided by the combined shapes of the exhaust manifold 60 and exhaust conduit 174. This stand pipe, or water trap, shape prevents water from being ingested during circumstances that could otherwise draw water upward through the exhaust conduit 174 from the body of water in which the marine engine is operated. This is particularly advantageous when the engine is positioned relatively low with respect to the level of water 190 of the body of water in which the vessel is operated. By providing the stand pipe, or water trap, structure illustrated in FIG. 5, the engine can be located at a point lower, relative to the surface of the body of water, than would otherwise be possible.

Figure 6:
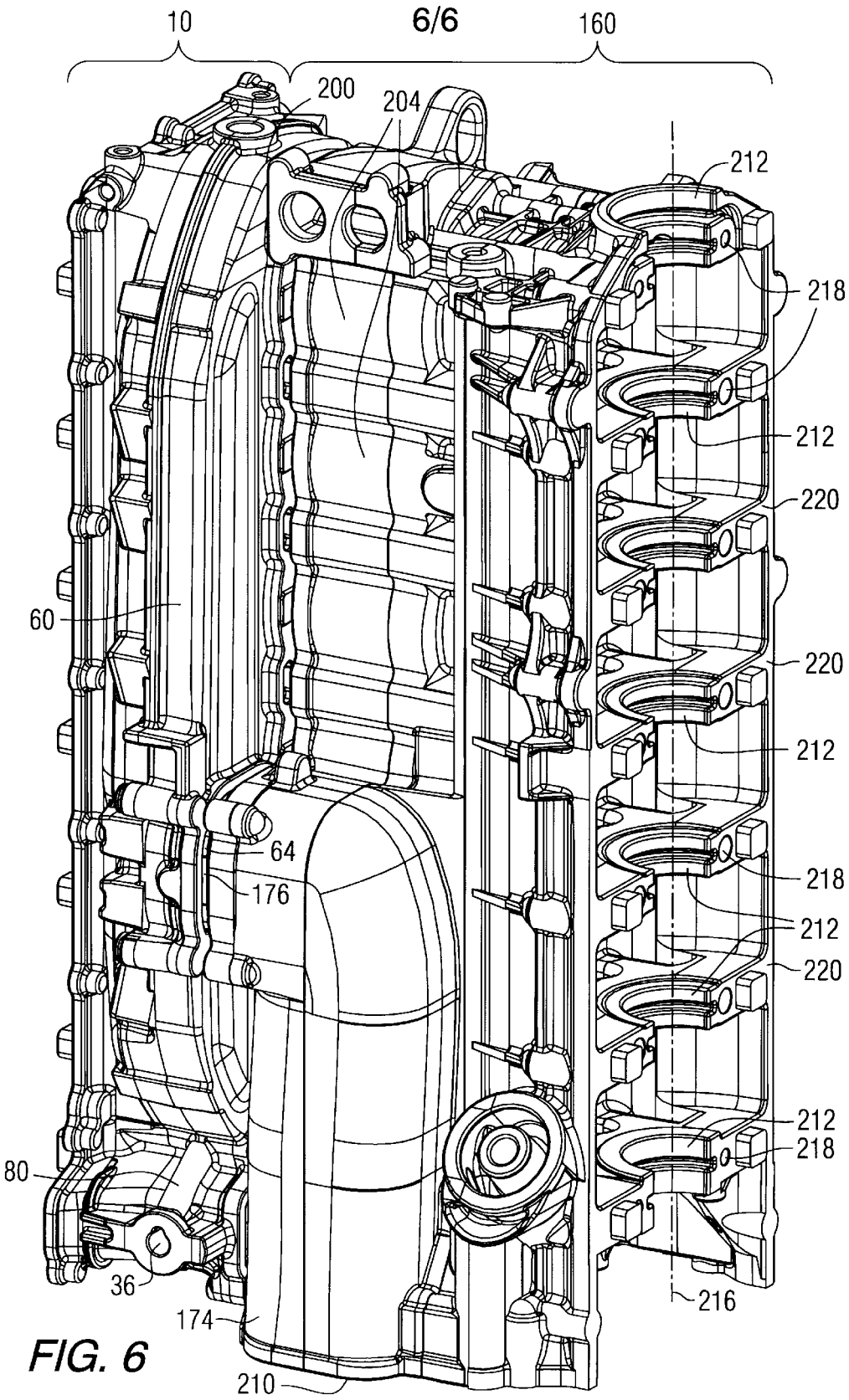
FIG. 6 is an isometric view of an engine showing a block portion and a head portion attached together.

FIG. 6 is an isometric view of the head portion 10 attached to the block portion 160 of an engine. Reference numeral 200 identifies the plane where the head portion 10 is attached in contact with the block portion 160. In the block portion, the outside surfaces of several of the cylinders 204 are visible. Also, the outside surface of the exhaust conduit 174 is shown as it extends upward from a bottom opening 210 and bends toward the head portion 10 where its exhaust inlet opening 176 (not clearly visible in FIG. 6) is aligned with the exhaust outlet opening 64 (also not clearly visible in FIG. 6).

For purposes of reference, the exhaust manifold 60 is identified in FIG. 6 as are the oil passage 80 and the opening 36 of the cam drive tensioner bore.

FIG. 6 also shows the bearing and support structures 212 which are shaped to receive and support a crankshaft for rotation about vertical axis 216. Holes 218 are provided to allow a crankcase cover to be attached to the block portion 160 for the purposes of enclosing the crankshaft within the resulting cavity. Surface 220 is a mating surface for the crankcase cover.

With continued reference to FIG. 6, it can be seen that the major heat producing areas of the engine are contained primarily within the head portion 10. These heat producing regions include the combustion chambers, 11–16, the exhaust manifold 60 and the exhaust ports 120. These heat producing regions in the head portion 10 are water jacketed with water passages 84 providing coolant in thermal communication with the regions. This type of structure, with the exhaust manifold integrally cast within the head portion 10 significantly simplifies the cooling procedure by confining the heat producing regions in a much more limited space rather than including an exhaust manifold in the block portion 160 of the engine, as is normally done.

With reference to FIGS. 1–6, it can be seen that the head portion 10 of the engine includes the exhaust manifold 60 within the structure of the head portion 10 and that the exhaust manifold 60 is formed simultaneously with the other portions and passages of the head portion of the engine during the initial casting procedure, which is normally a lost form casting procedure. As a result, the exhaust manifold 60 and the exhaust ports 120 are contained within the head portion 10 and are provided with a water jacket that comprises numerous water passages 84. Oil passages 80 are also provided at various selected locations within the head portion 10 and these oil passages 80 are formed during the casting process without the need for later machining which would otherwise increase the cost of the head portion 10 and the engine. The structure of the exhaust manifold 60 and its exhaust outlet opening 64 is advantageous because the location of the center 66 of the exhaust outlet opening 64 places it above at least one of the exhaust ports 120A. This creates the stand pipe, or water trap, structure which prevents water ingestion into the exhaust ports 120. This is accomplished by creating the raised portion of the passage, at level 180, which is above at least one of the exhaust ports 120A.

The design of an engine made in accordance with the preferred embodiment of the present invention addresses and solves several problems that are normally inherent in marine engines. One problem is the possibility of water intrusion, or water ingestion, when the engine is mounted relatively low with respect to the marine vessel. Secondly, the complexity of a cylinder block, when multi-port exhaust connections are used, can become excessive with a resulting increase in cost. Thirdly, it is desirable to cool the exhaust system, with a water jacket system, and the block portion of the engine with the same cooling water drawn from the body of water in which the marine vessel is operated. In typical multi-cylinder four cycle marine engines, each cylinder is provided with one or more exhaust ports that mate with matching passages formed in the block portion of the engine. These passages intersect an exhaust manifold within or attached to the body of the block portion, where the exhaust gas from all of the cylinders is mixed and routed down and out of the engine through a single passage. Normally, the exhaust passages in both the head portion and the block portion of the engine are water jacketed to limit the temperature of exposed metal surfaces and to help cool the exhaust gas before it enters sections of the outboard that are vulnerable to damage from excessive heat. The attached surfaces of both the head portion and block portion of the engine must provide adequate sealing for all of these exhaust passages. In addition, a significant concern exists related to the potential of water intrusion, or water ingestion, and this concern required alternative structures that are included in the present invention. The engine described above is intended for use at locations which are very low relative to the marine vessel and, as a result, very low relative to the surface to the body of water in which the marine vessel is operated. Under certain conditions, such as heavy loads in the marine vessel, a marine vessel with a low transom, a following wave, or a rapid engine shut down, the water level could be high enough to enter the exhaust ports of one or more cylinders through the exhaust passages. This would cause hydraulic lock and a severe component failure. The present invention implements a water trap, or stand pipe, that solves the water ingestion problem. This trap is implemented within the head portion of the engine and included as part of the exhaust manifold that is cast in place as an integral part of the head portion during a lost foam casting process. The present invention provides an exhaust manifold on one side of the head portion of the engine with a single exhaust outlet opening connecting with a single exhaust inlet opening formed in the block portion of the engine. The exhaust outlet opening of the exhaust manifold is located above at least one exhaust port so that at least one of the combustion chambers is below the exhaust outlet opening to prevent water ingestion. Although the exhaust outlet opening could be located at a point higher relative to the plurality of combustion chambers, cost, and weight considerations indicate that a more beneficial design is to locate the exhaust outlet opening above a certain number of combustion chambers and below a certain number of combustion chambers. Lost foam casting technology allows the water jacketed exhaust manifold to be formed integral with the head portion of the engine without additional covers, seals, gaskets, and fasteners. The preferred embodiment of the present invention is described in conjunction with a six cylinder in-line engine in which all six cylinders are aligned vertically with respect to each other. To promote adequate flow of exhaust gases toward the exhaust outlet opening, the exhaust ports from certain cylinders are angled upward toward the exhaust outlet opening while other exhaust ports from other combustion chambers are angled downward toward the exhaust outlet opening. In addition, the cross sectional area of the exhaust manifold increases in relation to the distance from the ends of the exhaust manifold to the center of the exhaust outlet passage for the purpose of increasing capacity as additional exhaust ports intersect with the exhaust manifold and add additional exhaust gases to the flow passing toward the exhaust outlet opening. In addition, the water jacketed exhaust manifold in the head portion of the engine provides a convenient passage for distributing preheated cooling water to the engine block portion. As a result of the features of the present invention, a trap is provided to prevent water intrusion or water ingestion, a single exhaust outlet opening is formed in the head portion to connect with a single exhaust inlet opening in the engine block portion, and the head portion is designed to be manufactured by the lost foam casting process. The lost foam casting process enables water jacketed around the exhaust passages without the need for extra components. Oil passages are also formed during the lost foam casting process. The present invention allows split exhaust ports, in which two exhaust throats are provided in each combustion chamber, and this characteristic facilitates cooling of the exhaust ports.

Although the present invention has been described in significant detail and illustrated to show one particularly preferred embodiment of the present invention, it should be understood that alternative embodiments are also within its scope.

What is claimed is:

1. An engine for a marine propulsion system, comprising:

a head portion of said engine having a plurality of combustion chambers formed therein, said plurality of combustion chambers being aligned vertically with respect to one another, said head portion of said engine being shaped to receive at least one cam shaft for rotation about a vertical axis;

an exhaust manifold formed integrally within said head portion of said engine;

a plurality of exhaust ports formed within said head portion of said engine, each of said plurality of exhaust ports being connected in fluid communication between an associated one of said plurality of combustion chambers and said exhaust manifold; and an exhaust outlet opening of said exhaust manifold, said exhaust outlet opening having a center located above at least one of said plurality of exhaust ports and below at least one of said plurality of exhaust ports.

2. The engine of claim 1, further comprising:

a block portion of said engine attached to said head portion of said engine.

3. The engine of claim 1, wherein:

said center of said exhaust outlet opening is located above two of said plurality of exhaust ports and below four of said plurality of exhaust ports.

4. The engine of claim 1, further comprising:

an exhaust conduit formed within said block portion of said engine, said exhaust conduit having an exhaust inlet opening.

5. The engine of claim 4, wherein:

said exhaust outlet opening of said exhaust manifold is aligned with said exhaust inlet opening of said exhaust conduit to form an exhaust passage which has a portion having a cross sectional area that is completely above at least one of said plurality of exhaust ports.

6. The engine of claim 1, wherein:

said plurality of combustion chambers comprises six combustion chambers.

7. The engine of claim 6, wherein:

each of said six combustion chambers is vertically aligned with each other of said six combustion chambers.

8. The engine of claim 1, wherein:

two of said plurality of exhaust ports are connected in fluid communication with each of said plurality of combustion chambers.

9. The engine of claim 1, wherein:

said head portion of said engine is made of a single aluminum casting with said exhaust manifold being formed integrally within said single aluminum casting of said head portion of said engine.

10. The engine of claim 9, further comprising;

an oil passage cast within said head portion of said engine.

11. The engine of claim 10, wherein:

said oil passage is disposed in fluid communication with cam shaft support structures formed integrally within said head portion of said engine.

12. An engine for a marine propulsion system, comprising:

a head portion of said engine having a plurality of combustion chambers formed therein, said plurality of combustion chambers being aligned vertically with respect to one another, said head portion of said engine being shaped to receive at least one cam shaft for rotation about a vertical axis;

a block portion of said engine attached to said head portion of said engine;

an exhaust manifold;

a plurality of exhaust ports formed within said head portion of said engine, each of said plurality of exhaust ports being connected in fluid communication between an associated one of said plurality of combustion chambers and said exhaust manifold; and an exhaust outlet opening of said exhaust manifold, said exhaust outlet opening having a center located above at least one of said plurality of exhaust ports and below at least one of said plurality of exhaust ports, said center of said exhaust outlet opening is located above two of said plurality of exhaust ports and below four of said plurality of exhaust ports.

13. The engine of claim 12, wherein:

said exhaust manifold is formed integrally within said head portion of said engine.

14. The engine of claim 13, further comprising:

an exhaust conduit formed within said block portion of said engine, said exhaust conduit having an exhaust inlet opening.

15. The engine of claim 14, wherein:

said exhaust outlet opening of said exhaust manifold is aligned with said exhaust inlet opening of said exhaust conduit to form an exhaust passage which has a portion having a cross sectional area that is completely above at least one of said plurality of exhaust ports.

16. The engine of claim 15, wherein:

said plurality of combustion chambers comprises six combustion chambers vertically aligned with each other of said six combustion chambers, two of said is plurality of exhaust ports being connected in fluid communication with each of said plurality of combustion chambers.

17. The engine of claim 12, further comprising:

an oil passage cast within said head portion of said engine, said head portion of said engine being made of a single aluminum casting with said exhaust manifold being formed integrally within said single aluminum casting of said head portion of said engine, said oil passage being disposed in fluid communication with cam shaft support structures formed integrally within said head portion of said engine.

18. An engine for a marine propulsion system, comprising:

a head portion of said engine having a plurality of combustion chambers formed therein, said plurality of combustion chambers being aligned vertically with respect to one another, said head portion of said engine being shaped to receive at least one cam shaft for rotation about a vertical axis;

a block portion of said engine attached to said head portion of said engine;

an exhaust manifold formed integrally within said head portion of said engine;

a plurality of exhaust ports formed within said head portion of said engine, each of said plurality of exhaust ports being connected in fluid communication between an associated one of said plurality of combustion chambers and said exhaust manifold;

an exhaust outlet opening of said exhaust manifold, said exhaust outlet opening having a center located above at least one of said plurality of exhaust ports and below at least one of said plurality of exhaust ports, said center of said exhaust outlet opening is located above two of said plurality of exhaust ports and below four of said plurality of exhaust ports;

an exhaust conduit formed within said block portion of said engine, said exhaust conduit having an exhaust inlet opening, said exhaust outlet opening of said exhaust manifold being aligned with said exhaust inlet opening of said exhaust conduit to form an exhaust passage which has a portion having a cross sectional area that is completely above at least one of said plurality of exhaust ports.

19. The engine of claim 18, further comprising:

an oil passage cast within said head portion of said engine, said head portion of said engine being made of a single aluminum casting with said exhaust manifold being formed integrally within said single aluminum casting of said head portion of said engine, said oil passage being disposed in fluid communication with cam shaft support structures formed integrally within said head portion of said engine.

* * * * *